US007895717B2

(12) United States Patent
Tuma

(10) Patent No.: US 7,895,717 B2
(45) Date of Patent: Mar. 1, 2011

(54) CLOSING MECHANISM COMPRISING AN ILLUMINANT, AND METHOD FOR PRODUCING ONE SUCH CLOSING MECHANISM

(75) Inventor: Jan Tuma, Harranberg (DE)

(73) Assignee: Gottlieb Binder GmbH & Co. KG, Hotzgerlingen (DE)

( * ) Notice: Subject to any disclaimer, the term of this patent is extended or adjusted under 35 U.S.C. 154(b) by 221 days.

(21) Appl. No.: 10/585,211

(22) PCT Filed: Dec. 28, 2004

(86) PCT No.: PCT/EP2004/014765

§ 371 (c)(1),
(2), (4) Date: Jul. 3, 2006

(87) PCT Pub. No.: WO2005/069697

PCT Pub. Date: Jul. 28, 2005

(65) Prior Publication Data

US 2007/0165393 A1 Jul. 19, 2007

(30) Foreign Application Priority Data

Jan. 15, 2004 (DE) ..... 10 2004 003 123

(51) Int. Cl.
*A44B 18/00* (2006.01)

(52) U.S. Cl. ..... 24/442; 362/103; 40/544

(58) Field of Classification Search ..... None
See application file for complete search history.

(56) References Cited

U.S. PATENT DOCUMENTS

| | | | | |
|---|---|---|---|---|
| 4,602,191 | A | 7/1986 | Davila | |
| 5,170,786 | A | 12/1992 | Thomas et al. | |
| 5,479,325 | A * | 12/1995 | Chien | 362/105 |
| 5,912,653 | A * | 6/1999 | Fitch | 345/87 |
| 6,142,643 | A * | 11/2000 | Araki et al. | 362/84 |
| 6,717,361 | B2 * | 4/2004 | Burrows | 313/512 |
| 6,811,895 | B2 * | 11/2004 | Murasko et al. | 428/690 |

FOREIGN PATENT DOCUMENTS

| | | |
|---|---|---|
| DE | 78 36 005 | 3/1979 |
| DE | 196 46 318 | 5/1998 |
| DE | 298 09 187 | 10/1999 |
| DE | 199 52 430 | 5/2001 |
| DE | 101 06 705 | 4/2002 |
| NL | 1 005 469 | 9/1998 |
| WO | WO 03/100317 | 12/2003 |

* cited by examiner

*Primary Examiner*—Jack W. Lavinder
(74) *Attorney, Agent, or Firm*—Roylance, Abrams, Berdo & Goodman, LLP

(57) ABSTRACT

A closing mechanism (1; 101; 201; 301) includes a plurality of closing elements (2; 102; 202; 302, 302*a*) such as hooks, mushroom heads or loops, and a flat carrier (3; 103; 203; 303). The closing elements (2; 102; 202; 302, 302*a*) protrude from at least one surface (4) of the carrier (3; 103; 203; 303). The closing mechanism (1; 101; 201; 301) has an illuminant (5; 105; 205; 305), at least in certain sections, which emits light when supplied with energy. The invention also relates to an associated production method.

36 Claims, 3 Drawing Sheets

Figure 1:
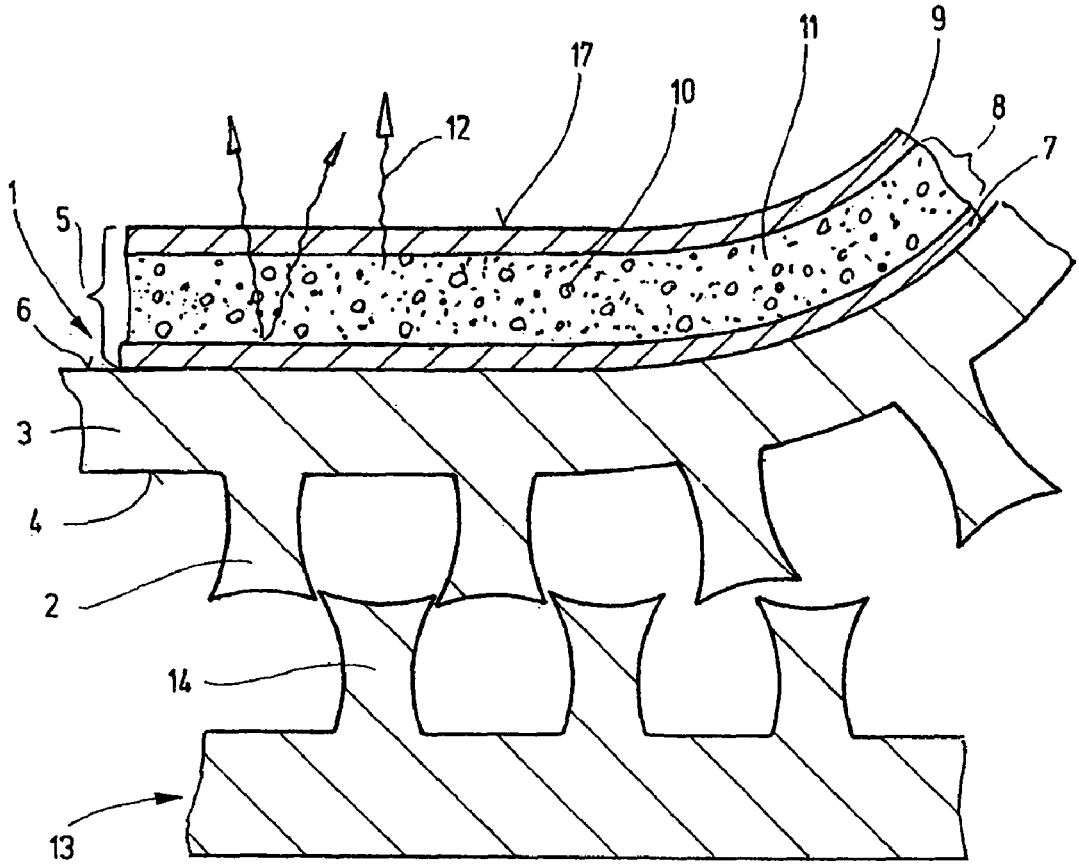

CLOSING MECHANISM COMPRISING AN ILLUMINANT, AND METHOD FOR PRODUCING ONE SUCH CLOSING MECHANISM

The invention relates to a closing mechanism comprising an illuminant and a method for producing one such closing mechanism.

Generic adhesive fastener components are known for example from DE 196 46 318 A1. An adhesive fastener generally formed from two adhesive fastener components which can be dynamically joined to each other is often used in textile or other articles of clothing and is also known as a Velcro® fastener. Other applications are for example mounting technology, for example for fastening of elements of interior trim in automotive engineering, or generally the production of a detachable fastening.

The object of the invention is to increase the functionality of adhesive fastener components and adhesive fasteners and to make available the pertinent production process for such an adhesive fastener component.

This object is achieved by the adhesive fastener component defined in claim 1 and by the production process defined in the subordinate claims. Special versions of the invention are defined in the dependent claims.

In an adhesive fastener component with a plurality of adhesive fastener elements such as for example hooks, mushroom heads, or loops, the adhesive fastener component having a flat carrier and the adhesive fastener elements protruding from at least one surface of the carrier, the object is achieved in that the adhesive fastener component has at least in certain sections an illuminant which emits light as a result of supply of energy, preferably as a result of the supply of electrical energy.

Preferably the illuminant is applied to the carrier as a sequence of electroluminescent layers, and in addition to the actual electroluminescent layer, also electrode layers, cover layers, reflection layers, and/or protective layers can be applied. Electroluminescence is defined as the property of certain substances to emit light as a result of the action of an electrical field. The layers can be applied masked or unmasked, or masking of one luminous layer can also be done by a correspondingly masked cover layer and/or such a reflection layer.

The adhesive fastener component can preferably be easily deformed elastically or plastically and can be drawn into almost any shape. Preferably the adhesive fastener component can also be deep-drawn while retaining its adhesion capacity and luminous capacity. Basically the illuminant can be located on the carrier and/or in the carrier. Preferably the illuminant can be applied in thick or thin film technology to the flat carrier of the adhesive fastener component or the illuminant is applied to another carrier which is connected to the flat carrier of the adhesive fastener component, especially is laminated onto it.

Fundamentally all processes known from thick and thin film technology are possible for application of the illuminant to the carrier of the adhesive fastener component. In one special embodiment of the invention, the illuminant is applied to the flat carrier by screen printing or offset printing. With application of the illuminant, conductor paths, terminal electrodes, or other electrical and/or electronic components can also be produced at the same time.

To the extent the material of the flat carrier of the adhesive fastener component enables it, for example consists of a polymer plastic which is semiconductive at least in certain sections, or of the corresponding textile materials, active electronic components such as for example field effect transistors can also be monolithically integrated into the adhesive fastener component. It is also possible to integrate hybrid circuit electronics, for example to fix circuits or solar cells on especially thin and therefore flexible silicon substrates of less than 50 μm thickness, preferably less than 20 μm, on or in the carrier or to incorporate them into a textile carrier. Thus, for example a voltage converter element can also be integrated, as is often necessary for operation of an electroluminescent cell.

Power can be supplied by an external energy storage device, or the adhesive fastener component can have an energy storage device, especially an electrochemical energy storage device in thin or thick film technology.

Preferably the carrier and/or the adhesive fastener elements are made from a polymer plastic, especially from polyolefins such as for example polypropylene or polyethylene, from polyamide, polyester or a biodegradable material. The plastic can be thermoplastically moldable and a method according to DE 196 46 318 A1 can be used for producing the adhesive fastener elements. As an alternative to a thermoplastic, a duroplastic, for example an acrylate plastic, can be used, in this case the crosslinking can be controlled by some amount of energy applied, especially by irradiation and/or by supplying heat, or some other suitable plastic can be used. By preference the adhesive fastener elements are made integral with the carrier. The adhesive fastener elements can also be produced as described in DE 101 06 705 C1, especially with an application device by which the adhesive fastener elements are built up in successively delivered droplets.

In one embodiment of the invention, lights or information displays can also be easily mounted at poorly accessible locations, with a high level of freedom of shapes, but in a space-saving manner and if necessary also detachably. For example, in this way emergency lights which are simple to mount can be implemented. In addition, as claimed in the invention dazzle-free flat lights can be implemented, also as a replacement or in addition to conventional lighting means. As claimed in the invention luminous advertising which can be easily interchanged can also be implemented.

The devices as claimed in the invention are thin, have a low weight, can be controlled in their illumination intensity and/or color temperature, and offer explosion-proof illumination. Based on a combination with an adhesive fastener component, complex two- and three-dimensional geometries can be permanently and reliably illuminated uniformly or with a definable light distribution. The service life potential is long compared to known illuminants, especially compared to illuminants having filaments. Terminal and connection contacts, like trigger electronics, can be integrated into the adhesive fastener component. For example, a receiver can be integrated into the adhesive fastener component, by which a control signal can be received and thereupon the illuminant is turned on and off. The wavelength of the emitted light can be in the range which is visible and/or invisible to humans, for example in the infrared range, so that even low luminous signal intensities can be detected by thermal imaging cameras.

For example, instructional, direction, and prohibition information in the form of words and/or pictures can be applied, especially printed, onto the illuminant. Preferably the illuminant is located on the surface of the adhesive fastener component opposite the adhesive fastener elements. As an alternative, adhesive fastener elements can also protrude from the two surfaces of the carrier. There can also be a partial surface free of adhesive fastener elements on the surface which otherwise has adhesive fastener elements, for application of the illuminant, especially when the carrier of the adhesive fastener component is transparent. In this way the illuminant and/or its electrical contact is protected by the carrier, in any case after attachment of the adhesive fastener component.

The carrier of the adhesive fastener component can also be a textile product, especially a product which has been produced by weaving, knitting, braiding, or embroidery. In this case, for example individual threads or thread groups, especially warp and/or weft threads, of different plies of the textile product can be made as connecting lines, for example by the latter being formed by conductive filaments or having a conductive coating. By preference the illuminant is located between two plies of the textile carrier, the emitted light being able to shine through the cover ply. In this case it is also possible to work, for example, weave, the information to be illuminated by the illuminant into the textile cover ply.

The invention also relates to a method for producing an adhesive fastener component with an illuminant as described above, by the illuminant being applied to the carrier onto which adhesive fastener elements have already been applied. In one special embodiment of the invention the illuminant is applied, especially printed, in thick or thin film technology, to the flat carrier. This is especially advantageous when the adhesive fastener elements and the flat carrier are made in one piece by thermoplastic shaping.

An electrical contact geometry of the illuminant is also possible by specifically influencing the electrical conductivity of individual or groups of adhesive fastener elements configured in a grid in regular structures. The adhesion of the illuminant to be applied, that is, its adhesion to the carrier of the adhesive fastener component, can be improved by surface treatment, especially by a gas atmosphere which increases the polarity of the carrier molecules near the surface.

Further advantages, features, and details of the invention will be apparent from the dependent claims and the following description, in which with reference to the drawings several exemplary embodiments are described in particular. In this connection the features mentioned in the claims and in the description are essential for the invention individually or in any combination.

Figure 2:
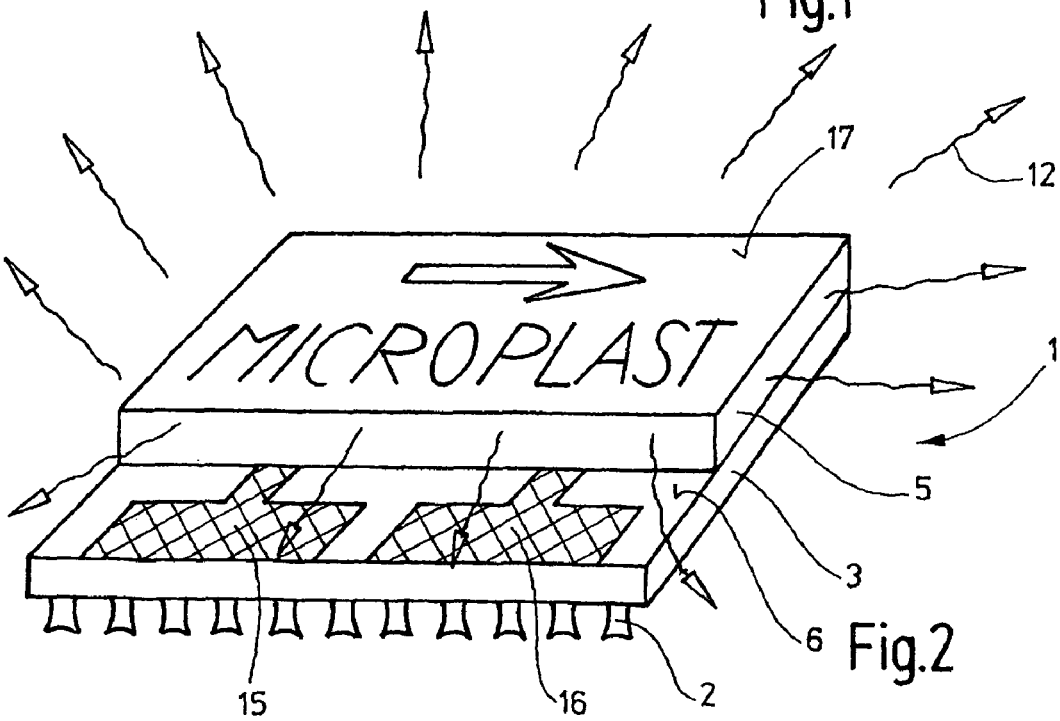
Figure 3:
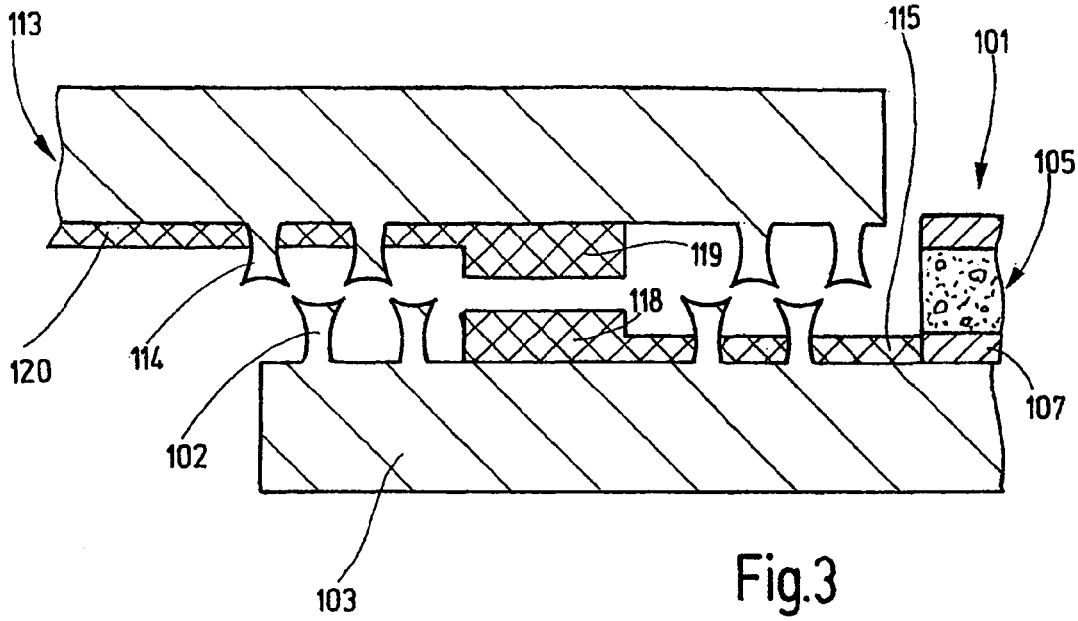
Figure 4:
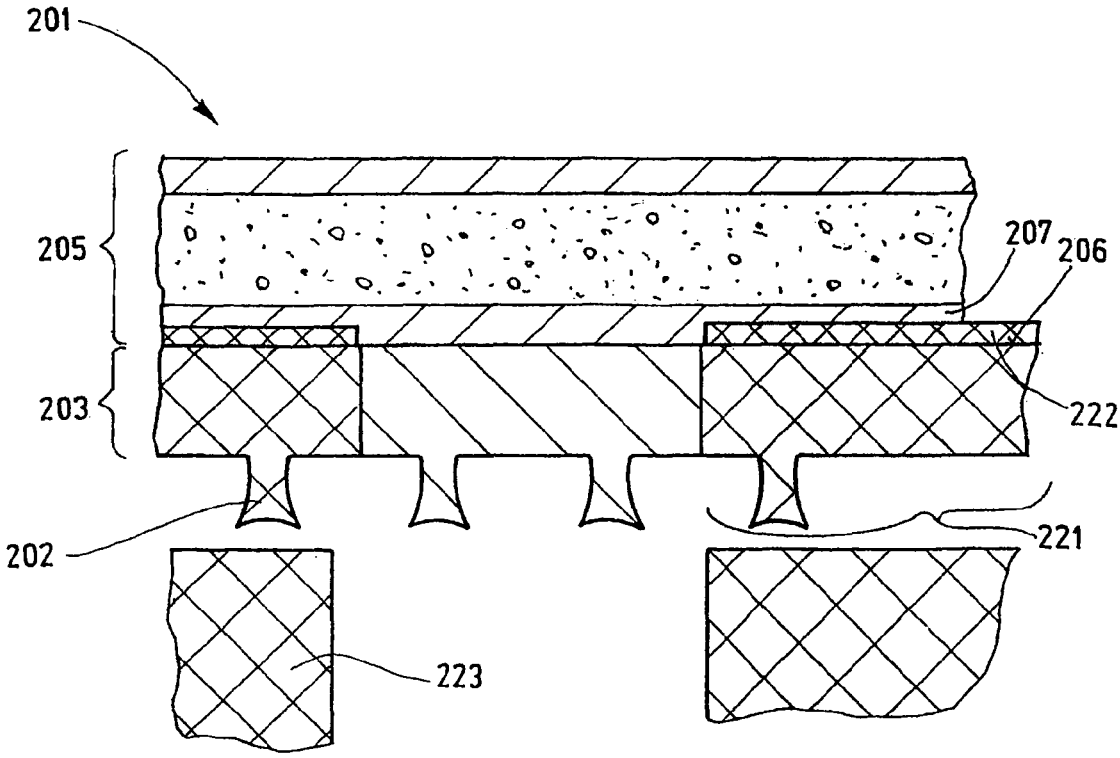
Figure 5:
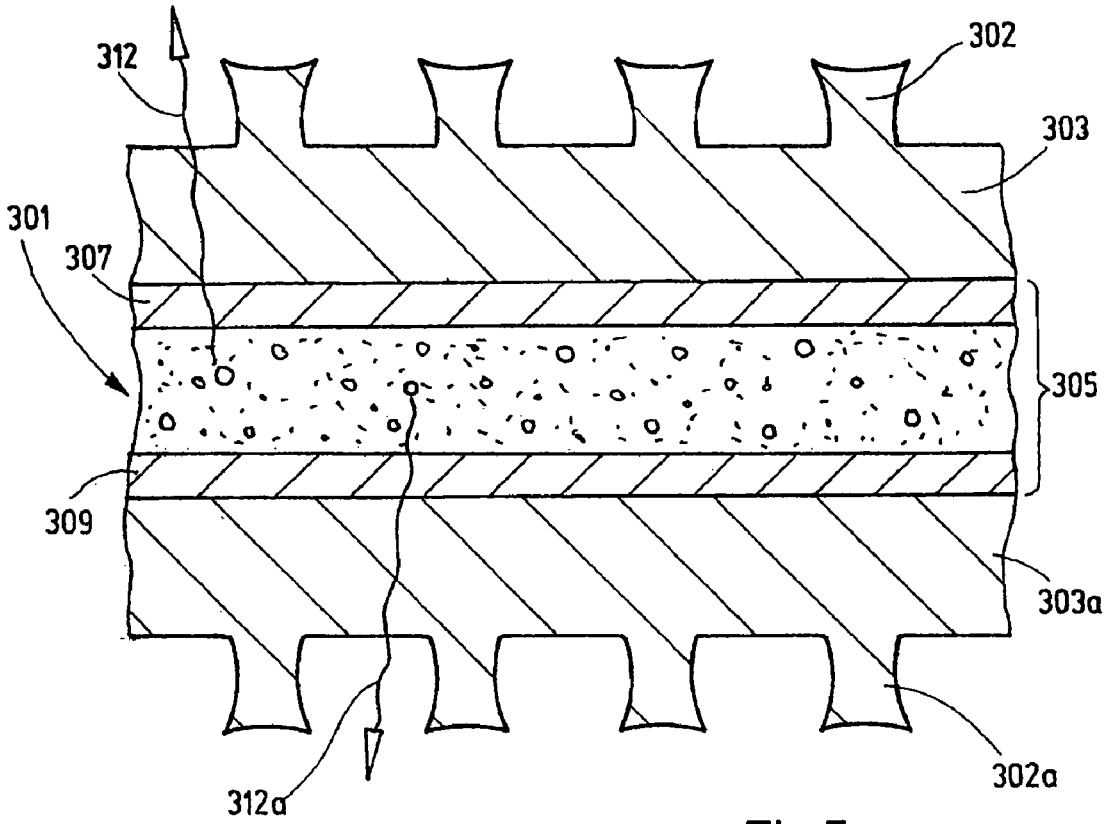
Figure 6:
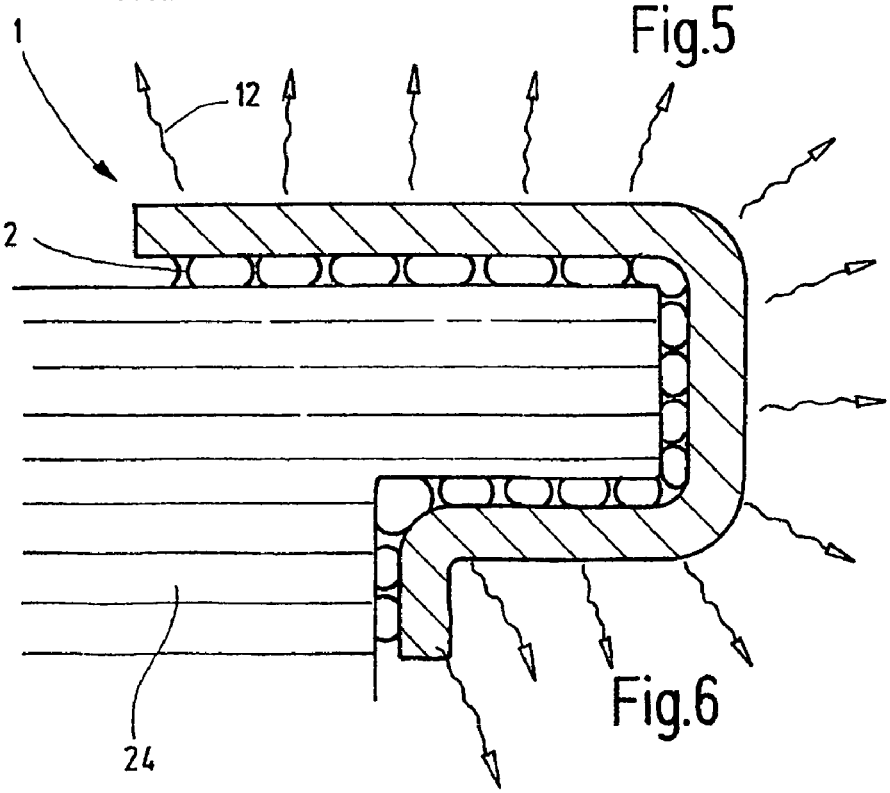

FIG. 1 shows a cross section through an adhesive fastener with an adhesive fastener component as claimed in the invention, FIG. 2 shows a perspective of the adhesive fastener component of FIG. 1, FIG. 3 shows a second exemplary embodiment of the invention, FIG. 4 shows a third exemplary embodiment of the invention, FIG. 5 shows a fourth exemplary embodiment of the invention, FIG. 6 shows one application of the adhesive fastener component as claimed in the invention.

FIG. 1 shows a cross section through an adhesive fastener with an adhesive fastener component 1 as claimed in the invention. It has a plurality of adhesive fastener elements 2 which are configured regularly in rows and columns and which are formed integrally with a flat carrier 3 of thermoplastically moldable plastic, and protrude obliquely and preferably at a right angle from a first surface 4 of the carrier 3.

On the second surface 6 opposite the first surface 4, there is an illuminant 5 on the carrier 3. The illuminant 5 is applied in thick film technology, especially by screen printing, to the carrier which already has the adhesive fastener elements 2 and which has been completed in this respect, and in addition to an electrically conductive base electrode 7 and an electrically likewise conductive, but transparent cover electrode 9, consists of a luminous layer 8 which is located in between and which has a filler matrix 11 and particles 10 of an electroluminescent substance intercalated in it. When an electrical field is applied, light is emitted by the particles 10, as is indicated by the arrows 12. The base electrode 7 is made as a reflection layer in order to increase radiant efficiency.

Electroluminescent substances are for example zinc sulfides and related compounds, the color of the emitted light being determined by the production process and/or by additives. To achieve a high luminance, currently AC voltages between 50 and 200 volts are necessary, with a frequency between 100 Hertz and 1 kHz. A higher voltage generally causes a higher luminance, by varying the frequency in certain ranges a change in the color of the emitted light can be induced; alternatively or in addition, the color can be adjusted by admixtures.

The layer thickness ratios both of the carrier 3 including the adhesive fastener elements 2 and also of the illuminant 5 are not shown to scale in the figures, especially for purposes of depiction individual layers are shown enlarged. Moreover the illuminant 5 can also have more than three layers, especially other layers for protection, for blocking moisture or for covering. The adhesive fastener component 1 as claimed in the invention can be joined, as shown in FIG. 1, to another adhesive fastener component 13 which is set up almost identically with respect to the carrier 3, in particular the adhesive fastener elements 2, 14 can be detachably in engagement with each other, or can also be joined to a textile adhesive fastener element or an article of textile clothing.

FIG. 2 shows a perspective view of the adhesive fastener component 1 from FIG. 1. This shows that in this exemplary embodiment the illuminant 5 does not completely cover the carrier 3 of the adhesive fastener component 1. Electrically conductive terminal electrodes and connecting lines 15, 16 are applied, especially printed, on the second surface 6 opposite the adhesive fastener elements 2. The electrodes and lines 15, 16 make contact with the pertinent terminal electrodes of the illuminant 5. When an electrical voltage in the range of approximately 100 volts is applied, light is emitted according to arrow 12. An information signal can be imprinted on the visible side surface 17 of the illuminant 5, in this case "MICROPLAST" with "arrow".

FIG. 3 shows a second exemplary embodiment of the adhesive fastener component 101 as claimed in the invention. In this exemplary embodiment the adhesive fastener elements 102 are located on the same surface as the illuminant 105. The area of the carrier 103 in which the illuminant 105 is located however is free of adhesive fastener elements 102. On the same surface the connecting lead 115 for the base electrode 107 of the illuminant 105 is routed up to the terminal protrusion 118.

Another adhesive fastener component 113 on its surface facing the adhesive fastener component 101 as claimed in the invention likewise has adhesive fastener elements 114 and a terminal protrusion 119 which is connected to the connecting lead 120. The adhesive fastener elements 102, 114 of the two adhesive fastener components 101, 113 are engaged to one another by pressing on them and at the same time the two terminal protrusions 118, 119 come into electrical contact. In this way, reliable contact with the base electrode 107 can be made via the connecting lead 120.

FIG. 4 shows a third exemplary embodiment of an adhesive fastener component 201 as claimed in the invention. The carrier 203 which consists preferably of a thermoplastic, like also the adhesive fastener elements 202 located in this area 221, is made electrically conductive by the corresponding modification of the plastic, as is indicated by the crosshatching, for example by intercalation of conductive particles. In these areas 221 the carrier 203 makes contact with the illuminant 205 located on the second surface 206, with a base electrode 207 which in the corresponding areas likewise has electrically conductive terminal electrodes 222 which are electrically connected to the electrically conductive adhesive fastener elements 202. In this way the adhesive fastener component 201 and especially the illuminants 205 can make electrical contact with the back of the carrier 203 which is opposite the illuminant 205, for example via external contact pieces 223.

FIG. 5 shows a fourth exemplary embodiment of an adhesive fastener component 301 as claimed in the invention which on both sides of the illuminant 305 has one respective carrier 303, 303*a* with adhesive fastener elements 302, 302*a* on the surface facing away from the illuminant 305. By attaching reflection layers to the surface of the carriers 303, 303*a* which faces the illuminant 305, it can be determined in which direction the light is emitted. In this exemplary embodiment there is no such reflection layer, in particular both the base electrode 307 and also the cover electrode 309 are made transparent, so that the light is emitted to two sides according to the arrows 312, 312*a*.

FIG. 6 shows one application of an adhesive fastener component 1 as claimed in the invention, simply for reasons of greater clarity the separating line between the carrier 3 and the illuminant 5 (see FIG. 1) not being shown. The adhesive fastener component 1 is fixed by means of the adhesive fastener elements 2 on a support body 24, with a surface which is formed for example by a textile fleece material, or on its surface another adhesive fastener component 13 is fixed over the entire surface or in certain sections, for example as a deep-drawn part. The adhesive fastener component 1 as claimed in the invention in spite of the projecting structure of the support body 24 ensures uniform illumination on all sides according to the light arrows 12, in particular shadowing of the area underneath the projection of the support body 24 is prevented. The adhesive fastener component 1 as claimed in the invention can be formed as a deep-drawn part while maintaining the adhesion fastening capacity and luminosity, so that in each instance even complexly shaped support bodies 24 fit precisely.

The invention claimed is:

1. A closing mechanism, comprising:

a flat carrier having first and second oppositely facing surfaces;

a plurality of releasable closing elements protruding from said first surface of said flat carrier;

a printed illuminant, emitting light upon being supplied with energy, applied directly on at least certain sections to said flat carrier by printing by one of thick film technology and thin film technology; and another illuminant laminated onto a flat carrier of an adhesive fastener component mated to said releasable closing elements.

2. A closing mechanism according to claim 1 wherein said closing elements are selected from the group consisting of hooks, mushroom heads and loops; and said illuminant is applied to said second surface of said flat carrier.

3. A closing mechanism according to claim 1 wherein said illuminant emits light upon being supplied with electrical energy.

4. A closing mechanism according to claim 1 wherein said illuminant is applied by one of screen printing and offset printing to said second surface of said flat carrier.

5. A closing mechanism according to claim 4 wherein said illuminant applied in thick film technology by screen printing to said second surface of said flat carrier.

6. A closing mechanism according to claim 1 wherein said flat carrier comprises at least one of conductor paths and terminal electrodes making electrical contact with said illuminant.

7. A closing mechanism according to claim 1 wherein said releasable closing elements are integral with said flat carrier.

8. A closing mechanism according to claim 1 wherein said flat carrier and said releasable closing elements comprise a jointly thermoplastic-shaped product.

9. A closing mechanism according to claim 1 wherein said flat carrier and said releasable closing elements comprise a polymer plastic selected from the group consisting of polypropylene, polyethylene and acylate plastic.

10. A closing mechanism according to claim 1 wherein said flat carrier is a textile product.

11. A closing mechanism according to claim 10 wherein said textile product is selected from the group consisting of a woven textile, a braided textile and an embroidered textile.

12. A closing mechanism according to claim 10 wherein said illuminant is located between two plies of said textile product.

13. A closing mechanism according to claim 1 wherein an electrochemical energy storage device is applied to said flat carrier by one of thick film technology and thin film technology.

14. A closing mechanism, comprising:

a flat carrier with first and second surfaces and having two plies of textile;

a plurality of releasable closing elements protruding from said first surface of said flat carrier; and an illuminant, emitting light upon being supplied with energy, said illuminant being between said two plies at least in certain sections thereof.

15. A closing mechanism according to claim 14 wherein said textile product is selected from the group consisting of a woven textile, a braided textile and an embroidered textile.

16. A closing mechanism, comprising:

a flat carrier having first and second oppositely facing surfaces and being a textile product;

a plurality of releasable closing elements protruding from said first surface of said flat carrier; and a printed illuminant, emitting light upon being supplied with energy, applied directly on at least certain sections to said flat carrier by printing by one of thick film technology and thin film technology.

17. A closing mechanism according to claim 16 wherein said closing elements are selected from the group consisting of hooks, mushroom heads and loops; and said illuminant is applied to said second surface of said flat carrier.

18. A closing mechanism according to claim 16 wherein said illuminant emits light upon being supplied with electrical energy.

19. A closing mechanism according to claim 16 wherein said illuminant is applied by one of screen printing and offset printing to said second surface of said flat carrier.

20. A closing mechanism according to claim 19 wherein said illuminant applied in thick film technology by screen printing to said second surface of said flat carrier.

21. A closing mechanism according to claim 16 wherein said flat carrier comprises at least one of conductor paths and terminal electrodes making electrical contact with said illuminant.

22. A closing mechanism according to claim 16 wherein said releasable closing elements are integral with said flat carrier.

23. A closing mechanism according to claim 16 wherein said flat carrier and said releasable closing elements comprise a jointly thermoplastic-shaped product.

24. A closing mechanism according to claim 16 wherein said flat carrier and said releasable closing elements comprise a polymer plastic selected from the group consisting of polypropylene, polyethylene and acylate plastic.

25. A closing mechanism according to claim 16 wherein said textile product is selected from the group consisting of a woven textile, a braided textile and an embroidered textile.

26. A closing mechanism according to claim 16 wherein said illuminant is located between two plies of said textile product.

27. A closing mechanism according to claim 16 wherein an electrochemical energy storage device is applied to said flat carrier by one of thick film technology and thin film technology.

28. A closing mechanism, comprising:

a flat carrier having first and second oppositely facing surfaces;

a plurality of releasable closing elements protruding from said first surface of said flat carrier;

a printed illuminant, emitting light upon being supplied with energy, applied directly on at least certain sections to said flat carrier by printing by one of thick film technology and thin film technology; and an electrochemical energy storage device applied to said flat carrier by one of thick film technology and thin film technology.

29. A closing mechanism according to claim 28 wherein said closing elements are selected from the group consisting of hooks, mushroom heads and loops; and said illuminant is applied to said second surface of said flat carrier.

30. A closing mechanism according to claim 28 wherein said illuminant emits light upon being supplied with electrical energy.

31. A closing mechanism according to claim 28 wherein said illuminant is applied by one of screen printing and offset printing to said second surface of said flat carrier.

32. A closing mechanism according to claim 28 wherein said illuminant applied in thick film technology by screen printing to said second surface of said flat carrier.

33. A closing mechanism according to claim 28 wherein said flat carrier comprises at least one of conductor paths and terminal electrodes making electrical contact with said illuminant.

34. A closing mechanism according to claim 28 wherein said releasable closing elements are integral with said flat carrier.

35. A closing mechanism according to claim 28 wherein said flat carrier and said releasable closing elements comprise a jointly thermoplastic-shaped product.

36. A closing mechanism according to claim 28 wherein said flat carrier and said releasable closing elements comprise a polymer plastic selected from the group consisting of polypropylene, polyethylene and acylate plastic.

* * * * *

UNITED STATES PATENT AND TRADEMARK OFFICE

CERTIFICATE OF CORRECTION

PATENT NO. : 7,895,717 B2
APPLICATION NO. : 10/585211
DATED : March 1, 2011
INVENTOR(S) : Tuma It is certified that error appears in the above-identified patent and that said Letters Patent is hereby corrected as shown below:

On the title page:

Item "(75) Inventor: Jan Tuma, Harranberg (DE)
(73) Assignee: Gottlieb Binder GmbH & Co. KG
Hotzgerlingen (DE)"

should read

Item -- (75) Inventor: Jan Tuma, Herrenberg (DE)
(73) Assignee: Gottlieb Binder GmbH & Co. KG
Holzgerlingen (DE) --

Signed and Sealed this
Twenty-first Day of June, 2011

David J. Kappos

David J. Kappos
*Director of the United States Patent and Trademark Office*